US008800418B2

(12) United States Patent
Guruprasad et al.

(10) Patent No.: US 8,800,418 B2
(45) Date of Patent: Aug. 12, 2014

(54) MOBILE MISSILE LAUNCH SYSTEM AND METHOD THEREOF

(75) Inventors: Siddalingappa Guruprasad, Maharashtra (IN); Shreedhar Aravind Katti, Maharashtra (IN); Alasani Prasad Goud, Maharashtra (IN); Vikas Narayan Waghmare, Maharashtra (IN); Sanjay Kumar, Maharashtra (IN); Atul Gupta, Maharashtra (IN); Ravindra Sudhakar Khire, Maharashtra (IN); Tushar Kant Santosh, Maharashtra (IN); Bimal Gautam, Maharashtra (IN); Paras Ram, Maharashtra (IN)

(73) Assignee: Director General, Defence Research & Development Organisation, Rajaji Marg (IN)

( * ) Notice: Subject to any disclaimer, the term of this patent is extended or adjusted under 35 U.S.C. 154(b) by 94 days.

(21) Appl. No.: 13/260,731

(22) PCT Filed: Jan. 11, 2010

(86) PCT No.: PCT/IN2010/000018

§ 371 (c)(1), (2), (4) Date: Sep. 27, 2011

(87) PCT Pub. No.: WO2010/113171

PCT Pub. Date: Oct. 7, 2010

(65) Prior Publication Data

US 2012/0036987 A1 Feb. 16, 2012

(30) Foreign Application Priority Data

| | | |
|---|---|---|
| Mar. 30, 2009 | (IN) | 00648/DEL/2009 |
| Mar. 31, 2009 | (IN) | 00684/DEL/2009 |
| Mar. 31, 2009 | (IN) | 00685/DEL/2009 |
| Apr. 6, 2009 | (IN) | 00703/DEL/2009 |

(51) Int. Cl.
*F41F 3/042* (2006.01)
*F41A 23/42* (2006.01)

(52) U.S. Cl.
CPC *F41A 23/42* (2013.01); *F41F 3/042* (2013.01)
USPC ..... 89/1.815

(58) Field of Classification Search
CPC ..... F41F 3/042; F41A 23/42
USPC ..... 89/1.806, 1.815, 1.8, 1.801, 1.804, 89/1.807, 1.813
See application file for complete search history.

(56) References Cited

U.S. PATENT DOCUMENTS 2,949,823 A * 8/1960 Ross et al. ..... 89/1.815
3,106,864 A * 10/1963 Seedlock et al. ..... 89/1.813

(Continued)

FOREIGN PATENT DOCUMENTS

DE 197 13 192 A1 10/1998
EP 1 710 530 A2 10/2006

(Continued)

*Primary Examiner* — Reginald Tillman, Jr.
(74) *Attorney, Agent, or Firm* — Ladas & Parry, LLP

(57) ABSTRACT

The present invention relates to launching system, more particularly relates to mobile launching system for missiles. The mobile missile launch system comprising a vehicle (14) having a chassis structure adapted to carry the launch system; a mounting frame (16) comprising predetermined truss framework mounted onto the chassis structure; plurality of sliding mechanisms mounted at rear end of the mounting frame (16); plurality of canisters (43) mounted onto said beam (22) and plurality of missiles (11) ensconced within the canisters (43); plurality of containers (42) enclosing said canisters (43) and are connected to the saddles (32, 34) for linear movement; plurality of resting units (27) abutting to rear end of the canisters (43) and are adapted to move linearly to transfer reaction forces from said missiles (11) to ground.

14 Claims, 23 Drawing Sheets

(56) References Cited

U.S. PATENT DOCUMENTS

Figure 1:
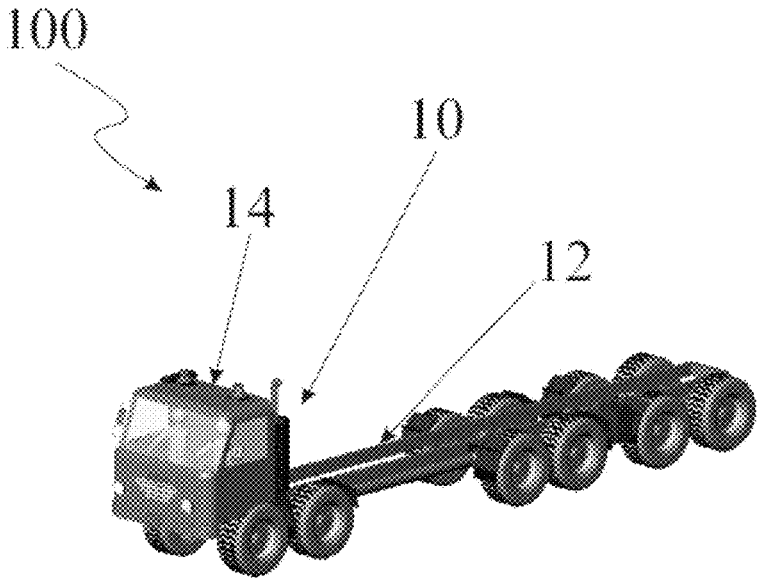

| | | | | | |
|---|---|---|---|---|---|
| 3,160,289 | A | * | 12/1964 | Leefer | 414/679 |
| 3,379,097 | A | * | 4/1968 | Fisher | 89/1.816 |
| 3,779,128 | A | | 12/1973 | Pelaez | 89/1.3 |
| 3,924,511 | A | | 12/1975 | Kendall et al. | 89/1.8 |
| 3,981,224 | A | | 9/1976 | Byars | 89/1.815 |
| 5,094,140 | A | | 3/1992 | Williams | 89/1.819 |
| 5,461,961 | A | | 10/1995 | Baus | 89/1.815 |
| 5,924,648 | A | * | 7/1999 | Ellinthorpe | 244/63 |
| 6,000,313 | A | | 12/1999 | Becker et al. | 89/40.02 |
| 6,584,881 | B1 | | 7/2003 | Boudreau | 89/1.804 |
| 6,742,433 | B2 | | 6/2004 | Smith | 89/1.815 |
| 7,891,281 | B2 | * | 2/2011 | Baldi et al. | 89/1.815 |
| 7,900,547 | B2 | * | 3/2011 | Atmur et al. | 89/1.815 |
| 8,266,999 | B1 | * | 9/2012 | Sisemore et al. | 89/1.815 |
| 2006/0086241 | A1 | | 4/2006 | Miller et al. | 89/1.802 |

FOREIGN PATENT DOCUMENTS

| | | | | |
|---|---|---|---|---|
| EP | 1 739 382 | A1 | | 1/2007 |
| FR | 2 531 200 | A1 | | 2/1984 |
| GB | 2 096 287 | A | | 10/1982 |
| JP | 05272896 | A | * | 10/1993 |
| JP | 06213594 | A | * | 8/1994 |
| JP | 9 210595 | A | | 8/1997 |
| WO | WO 99/17989 | A1 | | 4/1999 |

* cited by examiner

MOBILE MISSILE LAUNCH SYSTEM AND METHOD THEREOF

CROSS-REFERENCE TO RELATED APPLICATIONS

This application is the U.S. National Stage of International Patent Application No. PCT/IN2010/000018 filed on Jan. 11, 2010, which claims priority to Indian Patent Applications Nos. 00648/DEL/2009 filed on Mar. 30, 2009, 00684/DEL/2009 filed on Mar. 31, 2009, 00685/DEL/2009 filed on Mar. 31, 2009, and 00703/DEL/2009 filed on Apr. 6, 2009 the disclosures of which are hereby incorporated by reference in their entireties.

FIELD OF THE INVENTION

The present invention relates to launching system, more particularly relates to mobile launching system for missiles.

BACKGROUND OF THE INVENTION

Terrestrial Missile Launchers are launching mechanisms and platforms wherein missiles are fired from a fixed base. For this purposes, the missiles need to be transported from a warehouse or a silo to the launching base and effectively readied before deployment.

In today's warfare, with increased enemy surveillance, such fixed launching bases can easily be remotely profiled, located and targeted by an enemy, thus fracturing an important aspect of attack. Its immobility is one of its biggest hindrances.

Further, transportation of missiles from a silo to the launching base increases vulnerability to the enemy and provides them with an opportunity window to carry out destruction enroute. Destruction of missiles while being transported renders the launching platform useless and also causes a huge loss to the defenses.

As technology progresses, with increases surveillance, reconnaissance, targeting, offensive, and defensive systems in place, modern day warfare has progressed from static, open-faced warfare to dynamic, stealth, guerilla warfare; the underlying idea being to provide least possible awareness to the enemy about operating or firing locations. This need introduces the need for vehicles and mobile units, some of which may be even remotely monitored.

Typically, an Armoured Fighting Vehicle (AFV) is a terrestrial vehicle especially built and adapted for the purposes of combat and warfare. An AFV is protected with armour and armed with weapons for action on the battlefield.

Alternatively known as military land vehicles, the AFVs are typically a family of trucks and tanks suited for action within a battlefield and adapted to traverse a variety of terrain from hard concrete and tar to sand to semi-soft ground to swampy marshy land with ease. However, they cannot be used for deploying and launching long range missiles.

U.S. Pat. No. 5,094,140 discloses a missile launcher assembly which includes a fixed platform and further assemblies for missile support and launch. However, fixed launchers have their disadvantages as discussed above.

Smaller weapon systems can easily be fitted onto such vehicles to achieve short range target compatibility. Combat land vehicles with rocket launchers are disclosed in U.S. Pat. No. 5,461,961 and U.S. Pat. No. 6,584,881.

U.S. Pat. No. 6,742,433 discloses a launcher platform (on a vehicle) which includes a support structure and a number of rails mounted on the support structure for supporting missiles thereon. This assembly is not suitable for long range heavy missiles which cannot be launched at an angle and which require stable ground support to dampen the recoil thrust that is developed during launch.

U.S. Pat. No. 3,981,224 discloses a missile transporter-launcher which describes a launcher carried on the flatbed of a mobile vehicle to provide the dual role of missile transporter and pre-launch positioning of its multi-missile payload. Although articulating means are described in this patent, the articulating means provides elevation to the missiles up to a certain angle only. As is the case with U.S. Pat. No. 6,742,433, the U.S. Pat. No. 3,981,224 is not suitable for long range heavy missiles with heavy payloads as they need a firm base for dampening the recoil thrust developed during launch.

There is a need for improvement in missile carrying vehicles; to deploy missiles from said vehicle, to make it terrestrially mobile in order to skillfully improve ground coverage in war zones. There is also a need for a fast articulating launcher assembly which increases the military's ability to operate with agility without compromising on ground movement and thus decreasing the threat of being noticed.

OBJECTS OF THE INVENTION

The principal object of the invention is to provide a mobile missile system for carrying the missiles and firing said missiles from said mobile system itself.

Another object of this invention is to provide a mobile missile system with a fast articulating and actuating system for readying the missiles for firing from said mobile system itself.

Still another object of this invention is to provide a mobile missile system with a convenient missile deploying interface and capability.

Yet another object of this invention is to provide a mobile missile system having an accurate missile deploying capability.

Still another object of this invention is to provide a quick moving and agile mobile missile system.

An additional object of this invention is to provide a mobile missile system which does not require an external power source either for its movement or for its missile deploying capability.

STATEMENT OF THE INVENTION

Accordingly, the present invention provides for a mobile missile launch system (100), said system comprising: a vehicle (14) having a chassis structure (12) adapted to carry the launch system; a mounting frame (16) comprising predetermined truss framework mounted onto the chassis structure (12); plurality of sliding mechanisms mounted at rear end (19) of the mounting frame (16) comprising; a beam (22) comprising plurality of sliders (26) on one surface and is hinged to the mounting frame (16) on other surface, plurality of saddles (32, 34) mounted onto the beam (22) and are adapted to slide on the sliders (26), a tube (35) having an opening fixed to the saddle (32) at one end and an end cap (39) at other end, an actuator (31) connected to the tube (35) through a piston (29) and rod (37) and is hinged at one end on the beam (22), wherein said piston (29) actuation contacts the rod (37) with end cap (39) of the tube (35) to slide saddles (32, 34) on the sliders (26); plurality of canisters (43) mounted onto said beam (22) and plurality of missiles (11) ensconced within the canisters (43); plurality of containers (42) enclosing said canisters (43) and are connected to the saddles (32, 34) for linear movement; plurality of resting units (27) abutting to rear end of the canisters (43) and are adapted to move linearly to transfer reaction forces from said missiles (11) to ground (51); communication means/mast (56) placed within the launch system to communicate with remotely located unit; and at least one locking mechanism and at least one holding device mounted at front end of each container (42) to arrest linear motion of the container (42) during mobility in horizontal position, also provides for a method for holding a missile (11) securely comprising act of actuating hydraulic cylinders (8) for applying pressure onto housing elements (17) for moving protruding pins (13) of the housing elements (17) for inserting into stub holes (6) of the missile (11) for holding the missile (11) securely, wherein a detachable stub element (2) is integrated with the missile (11) below tip surface and is mounted inside the bracket (3) of the platform (20), and said stub element (2) comprising one or more stub holes (6) to accommodate the pins (13) provided at preformed shaped element (17*a*) and has at least one protruding element (4) at centre, wherein said protruding element (4) is mounted inside the hole (5) of platform (20), also provides for a method for arresting linear motion of missile (11) comprising an act of activating actuator assembly (200) by removal of hydraulic fluid, causing pre-tensioned springs (200*a*) to act against arms (200*b*) of clevis (200*d*)) due to the removal of hydraulic fluid, wherein piston (200*e*) is thrust forward onto said clevis (200*d*) and forwardly extended stub (200*g*), applying load on rocker assembly (101*b*) by the extended stub (200*g*) which is transferred as point load onto loading elements and nose cap projection (90) at operative top end of rocker assembly (101) to arrest linear motion of the missile (11), wherein the rocker assembly (101) is pivoted at bracket of the system comprises an actuating segment (101*a*) at lower side and a loading segment (101*c*) at upper side and a rocker segment (101*b*) disposed in between the actuating segment (101*a*) and the loading segment (101*c*), and also provides for a method of launching a missile (11), said method comprising acts of; actuating beam (22) by actuator (24) to move from its horizontal position to vertical position; actuating actuator (31) by releasing pressure, wherein said releasing of the pressure allows resting unit (27) to touch ground (51); and launching of the missile (11) using control switches, wherein thrust forces generated by the launch of the missile (11) is transferred to the ground (51) through resting unit (27).

BRIEF DESCRIPTION OF THE ACCOMPANYING DRAWINGS

Figures 21A, 21B, 21C:
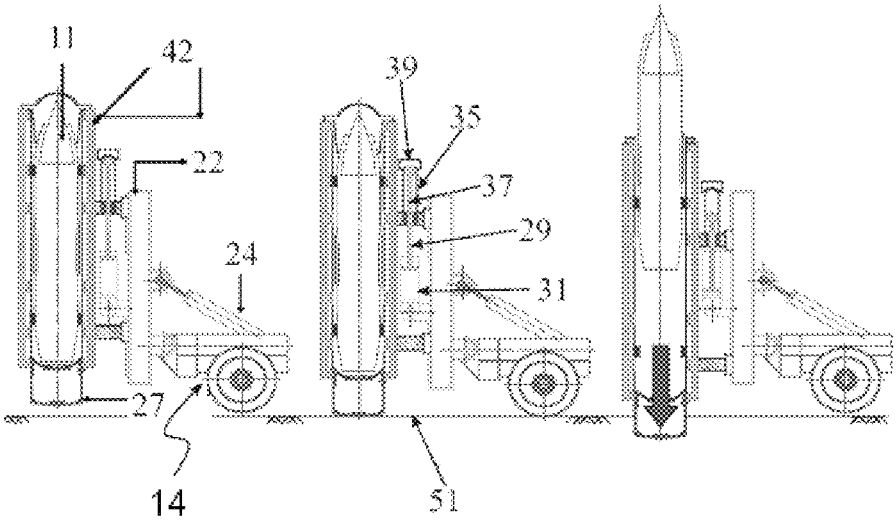
Figure 22:
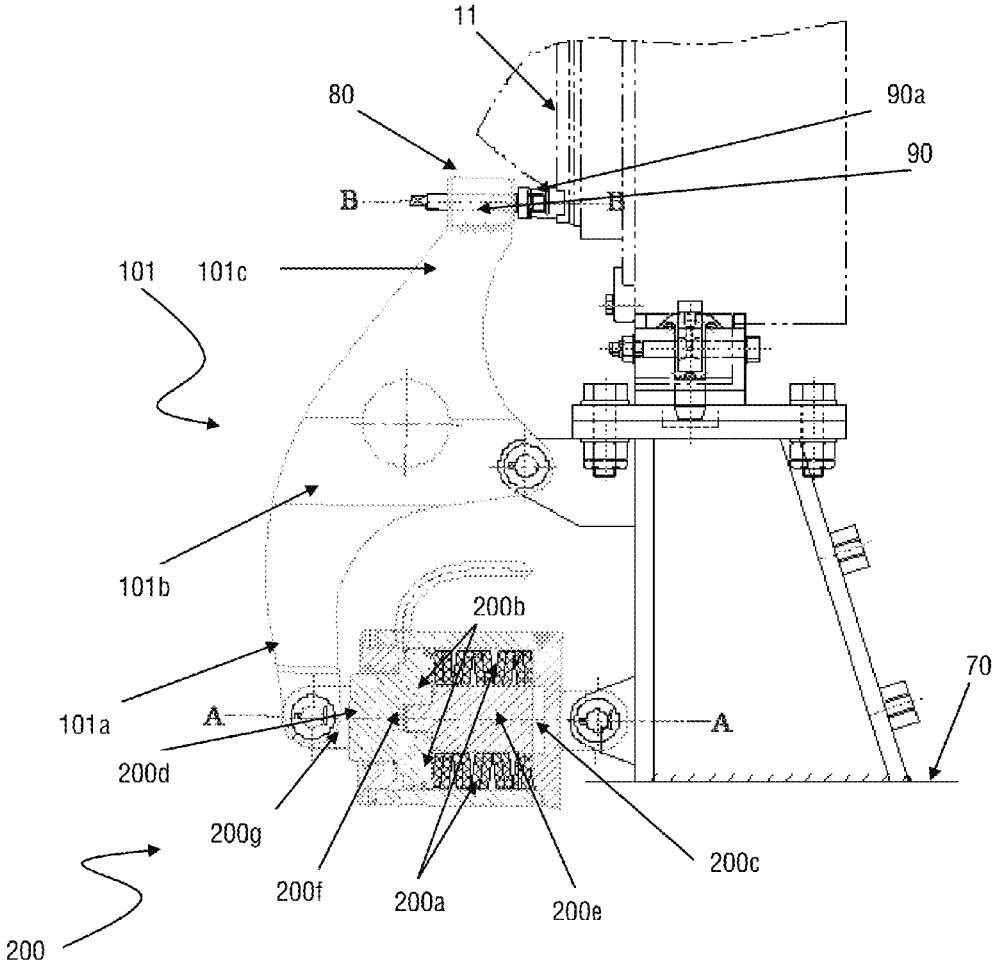
Figure 23:
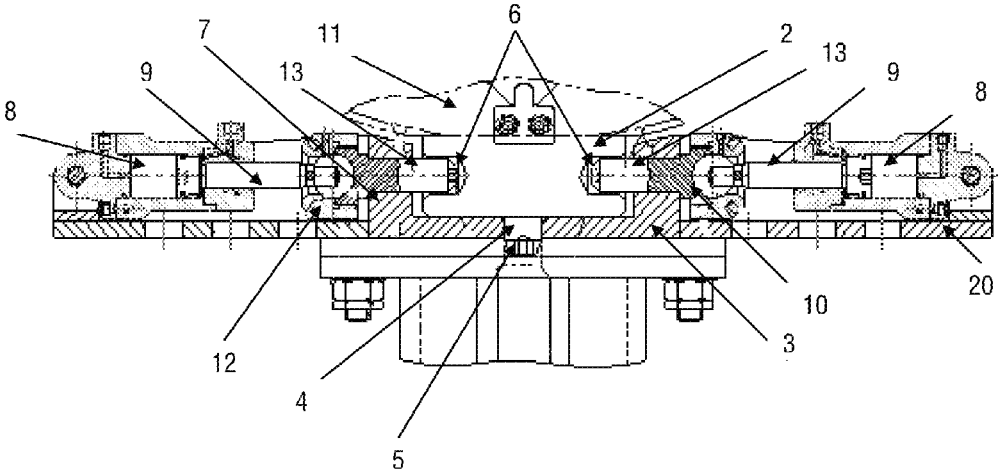

The invention will now be described in accordance with the accompanying drawings, in which:

FIGS. 1 to 20 illustrates a step-by-step exploded view of the various embodiments of the mobile missile launching system;

FIGS. 21*a*, 21*b*, and 21*c* illustrate the missile articulating system of the mobile missile system in accordance with this invention;

FIG. 22 illustrates side view of the rocker assembly in its engaged position; and FIG. 23 illustrates a side view of an assembly for holding the missile mounted on a mobile platform in locked position, in accordance with this invention.

DETAILED DESCRIPTION OF THE INVENTION

Referral Numerals

2—stub element
3—bracket
4—protruding element
5—hole
6—stub holes
7—apertures
8—hydraulic cylinder
9—shaft of cylinder
10—cabin
11—missile
12—chassis structure of the vehicle
13—pins
14—vehicle
15—preformed shaped bearing
16—mounting frame
17—housing element
17*a*—preformed shaped element
18—front section of mounting frame
19—rear section of mounting frame
20—platform for mounting holding assembly
22—beam
24—beam actuator cylinder
26—sliders
27—resting unit
28—metal block
29—piston
30—metal railing
31—actuator
32, 34—saddles
35—tube
36—accumulator
37—rod
38—thermal conditioning unit
39—end cap
40—hydraulic reservoir
42—container
43—canister
44—front supports
46—outriggers
48—a system comprising hydraulic pump, motor, and fan
50—equipment control cabin
51—ground
52—power supply cabin
54—system comprising alternator and motor
56—communication mast/means
70—platform for mounting of rocker assembly
80—loading socket
90—nose cap
90*a*—loading pin
100—Mobile missile launch system
101—rocker assembly
101*a*—actuating segment
101*b*—rocker segment
101*c*—loading segment
200—actuator assembly
200*a*—springs
200*b*—arms
200*c*—rear wall
200*d*—clevis
200*e*—piston
200*f*—boss
200*g*—stub The present invention is in relation to a mobile missile launch system (100), said system comprising: a vehicle (14) having a chassis structure (12) adapted to carry the launch system; a mounting frame (16) comprising predetermined truss framework mounted onto the chassis structure (12); plurality of sliding mechanisms mounted at rear end (19) of the mounting frame (16) comprising; a beam (22) comprising plurality of sliders (26) on one surface and is hinged to the mounting frame (16) on other surface, plurality of saddles (32, 34) mounted onto the beam (22) and are adapted to slide on the sliders (26), a tube (35) having an opening fixed to the saddle (32) at one end and an end cap (39) at other end, an actuator (31) connected to the tube (35) through a piston (29) and rod (37) and is hinged at one end on the beam (22), wherein said piston (29) actuation contacts the rod (37) with end cap (39) of the tube (35) to slide saddles (32, 34) on the sliders (26); plurality of canisters (43) mounted onto said beam (22) and plurality of missiles (11) ensconced within the canisters (43); plurality of containers (42) enclosing said canisters (43) and are connected to the saddles (32, 34) for linear movement; plurality of resting units (27) abutting to rear end of the canisters (43) and are adapted to move linearly to transfer reaction forces from said missiles (11) to ground (51); communication means (56) placed within the launch system to communicate with remotely located unit; and at least one locking mechanism and at least one holding device mounted at front end of each container (42) to arrest linear motion of the container (42) during mobility in horizontal position.

In still another embodiment of the present invention the truss frame work of mounting frame (16) is configured as front frame work (18) and rear truss frame work (19) for varying loads of mountings on it.

In yet another embodiment of the present invention the front (18) and rear truss frame work (19) are configured for mounting of actuators for articulation, fire control section and power supply cabin (52) and beam (22), actuators for articulation respectively.

In yet another embodiment of the present invention said system is fitted with thermal conditioning unit (38) to regulate temperature inside the canister (43).

In yet another embodiment of the present invention said system is fitted with plurality of accumulators (36) connecting to actuators and are adapted to store for articulation of the beam (22).

In yet another embodiment of the present invention the actuator (31) is preferably a hydraulic actuator for actuating piston (29) movement.

In yet another embodiment of the present invention the holding device for container (42) comprising platform (20) of predetermined shape having at least one bracket (3) consisting of one or more apertures (7) and at least one hole (5) at centre; detachable stub element (2) is integrated with the missile (11) below tip surface and is mounted inside the bracket (3) of the platform (20), said stub (2) comprising one or more stub holes (6) to accommodate pins (13) provided at preformed shaped element and has at least one protruding element (4) at centre, wherein said protruding element (4) is mounted inside the hole (5) of platform (20); plurality of hydraulic cylinders (8) having shaft (9) and are mounted at predefined positions onto the platform (20) on either side of the bracket (3); and plurality of housing elements (17) fitted to preformed shaped element (17*a*); and the shaft (9) of each hydraulic cylinder (8) is fitted with preformed shape of bearing (15) as shown in FIG. 23.

In yet another embodiment of the present invention the shaft (9) of cylinder, the bearings (15), the housing element (17) and the preformed shaped element (17*a*) form a ball and socket mechanism.

In yet another embodiment of the present invention the pins (13) pass through the apertures (7) in the bracket (3) to get inserted in the holes (6) of the stub element (2).

The present invention is in relation to a method for holding a missile (11) securely comprising act of actuating hydraulic cylinders (8) for applying pressure onto housing elements (17) for moving protruding pins (13) of the housing elements (17) for inserting into stub holes (6) of the missile (11) for holding the missile (11) securely, wherein a detachable stub element (2) is integrated with the missile (11) below tip surface and is mounted inside the bracket (3) of the platform (20), and said stub element (2) comprising one or more stub holes (6) to accommodate the pins (13) provided at preformed shaped element (17*a*) and has at least one protruding element (4) at centre, wherein said protruding element (4) is mounted inside the hole (5) of platform (20).

In yet another embodiment of the present invention the locking mechanism to arrest linear motion of the missile (11) comprising a rocker assembly (101) of predetermined shape pivoted at bracket of the system, said rocker assembly (101) comprises an actuating segment (101*a*) at lower side and a loading segment (101*c*) at upper side and a rocker segment (101*b*) disposed in between the actuating segment (101*a*) and the loading segment (101*c*); an actuator assembly (200) connected to lower end of platform (70) of the system for applying load to the rocker assembly (101); and loading elements engaged at operative top end of the rocker assembly (101) to arrest linear motion of the missile (11) as shown in FIG. 22.

In yet another embodiment of the present invention the rocker assembly (101) is tapered away from the rocker segment (101*b*) and leads to the actuating segment (101*a*) at lower side and a the loading segment (101*c*) at upper side.

In yet another embodiment of the present invention a medially placed pivoting arrangement enables the rocker assembly (101) to pivot about.

In yet another embodiment of the present invention the pivoting arrangement and the bracket have matching holes to superimpose onto each other.

In yet another embodiment of the present invention the pivoting arrangement is secured by inserting a pin and circlip through matching holes.

In yet another embodiment of the present invention the actuator assembly (200) comprises plurality of pre-tensioned springs (200*a*) and a hydraulic actuator having a piston (200*e*) with a boss (200*f*) at its operative end.

In yet another embodiment of the present invention the actuator assembly (200) comprises a clevis (200*d*) with plurality of arms (200*b*) aligned with the piston (200*e*).

In yet another embodiment of the present invention the springs (200*a*) are placed between arms (200*b*) of the clevis (200*d*) and rear wall (200*c*) of the actuator assembly (200).

In yet another embodiment of the present invention the piston (200*e*) is placed symmetrically in between the springs (200*a*).

In yet another embodiment of the present invention the springs (200*a*) are preferably Belleville springs.

In yet another embodiment of the present invention the loading elements comprises a loading socket (80) and a loading pin (90*a*) which is aligned in horizontal linear axis configuration with nose cap projection (90) of the missile (11).

The present invention is in relation to a method for arresting linear motion of missile (11) comprising an act of activating actuator assembly (200) by removal of hydraulic fluid, causing pre-tensioned springs (200*a*) to act against arms (200*b*)) of clevis (200*d*) due to the removal of hydraulic fluid, wherein piston (200*e*) is thrust forward onto said clevis (200*d*) and forwardly extended stub (200*g*), applying load on rocker assembly (101) by the extended stub (200*g*) which is transferred as point load onto loading elements and nose cap projection (90) at operative top end of rocker assembly (101) to arrest linear motion of the missile (11), wherein the rocker assembly (101) is pivoted at bracket of the system comprises an actuating segment (101*a*) at lower side and a loading segment (101*c*) at upper side and a rocker segment (101*b*) disposed in between the actuating segment (101*a*) and the loading segment (101*c*).

In yet another embodiment of the present invention the load is applied onto the actuator segment (101*a*) by removing fluid from hydraulic actuator of the actuator assembly (200).

In yet another embodiment of the present invention removing the fluid makes pre-tensioned springs (200*a*) to exert pressure to move clevis (200*d*) in forward direction.

In yet another embodiment of the present invention the loading elements includes a loading socket (80) and a loading pin (90*a*) for applying point load on to the nose cap projection (90).

The present invention is in relation to a method of launching a missile (11), said method comprising acts of actuating beam (22) by actuator (24) to move from its horizontal position to vertical position; actuating actuator (31) by releasing pressure, wherein said releasing of the pressure allows resting unit (27) to touch ground; and launching of the missile (11) using control switches, wherein thrust forces generated by the launch of the missile is transferred to the ground (51) through the resting unit (27).

In yet another embodiment of the present invention said method comprises act of retracting piston (29) upwards to release the ground resting unit (27) from the ground (51) after launching.

Figure 2:
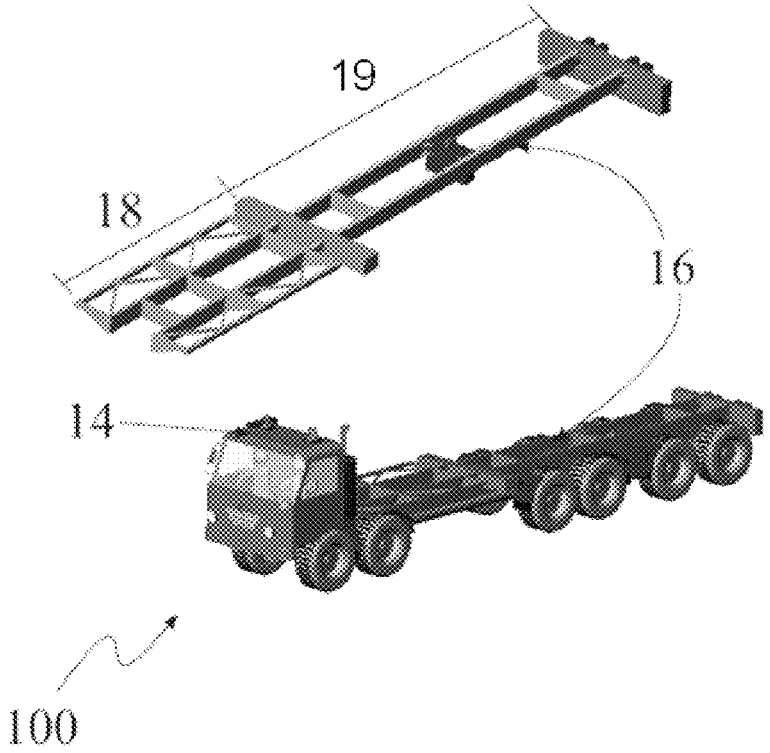
Figure 3:
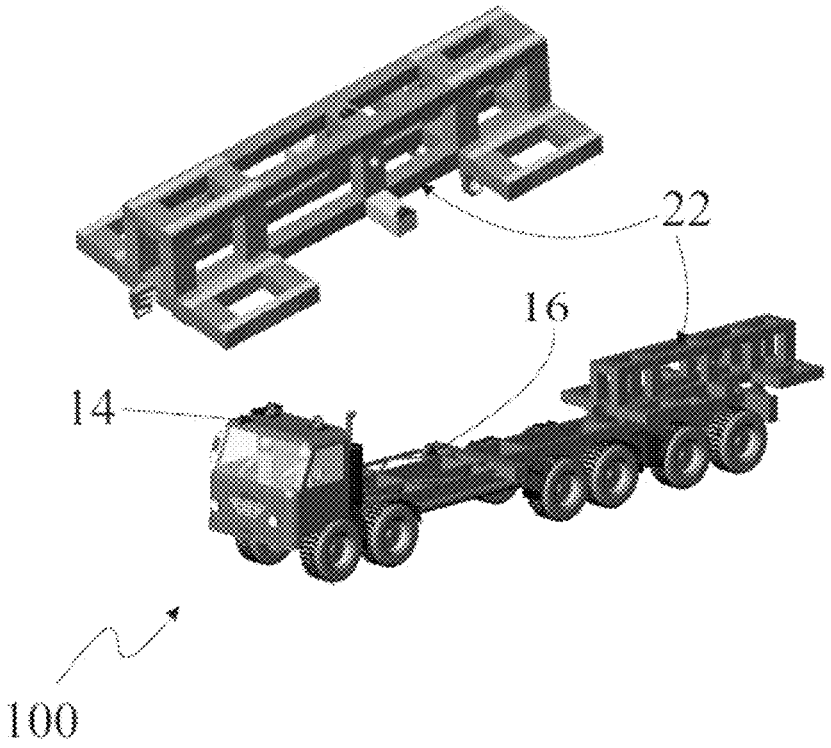
Figure 4:
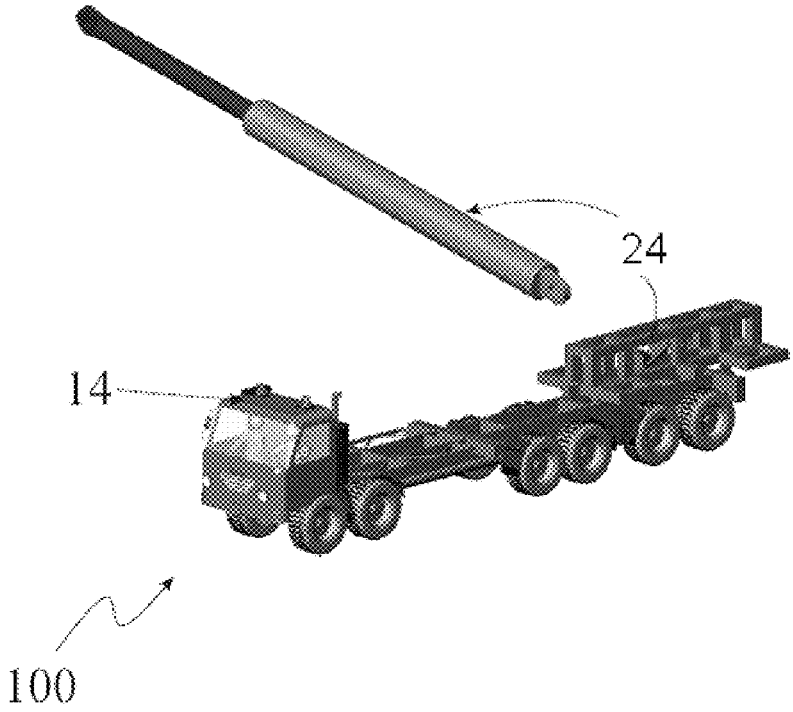
Figure 5:
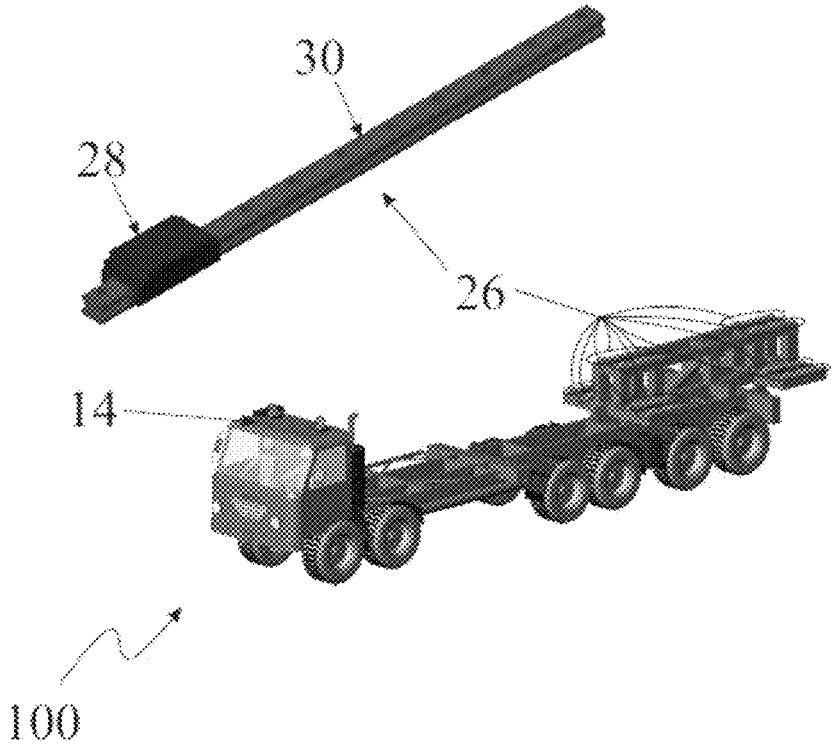
Figure 6:
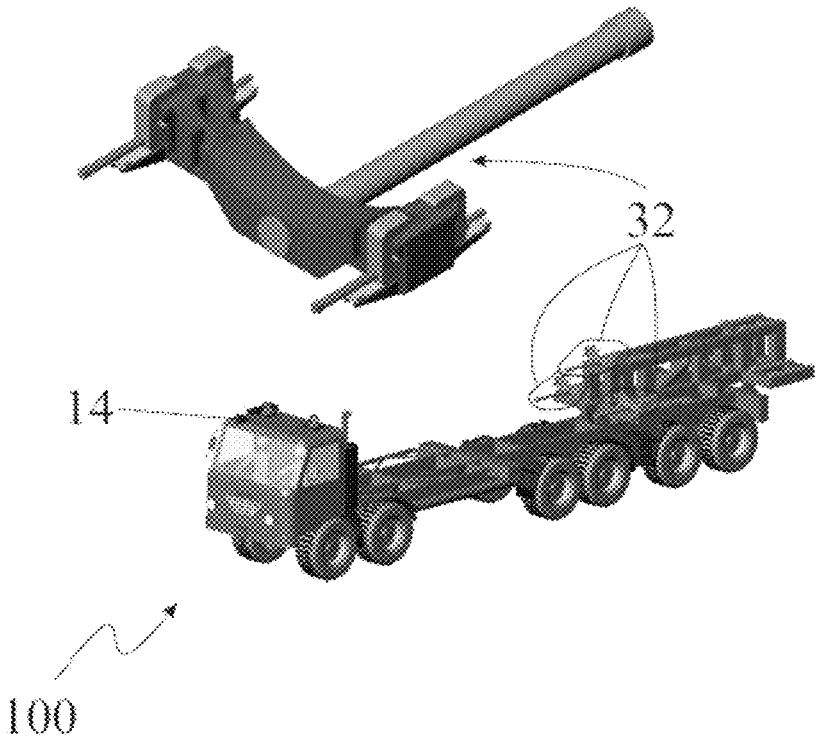
Figure 7:
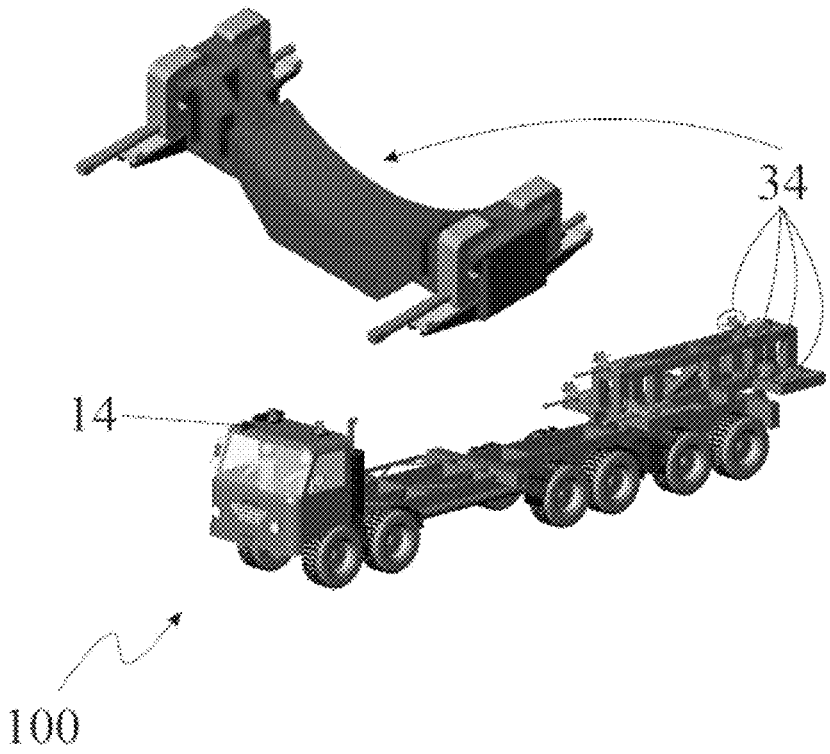
Figure 8:
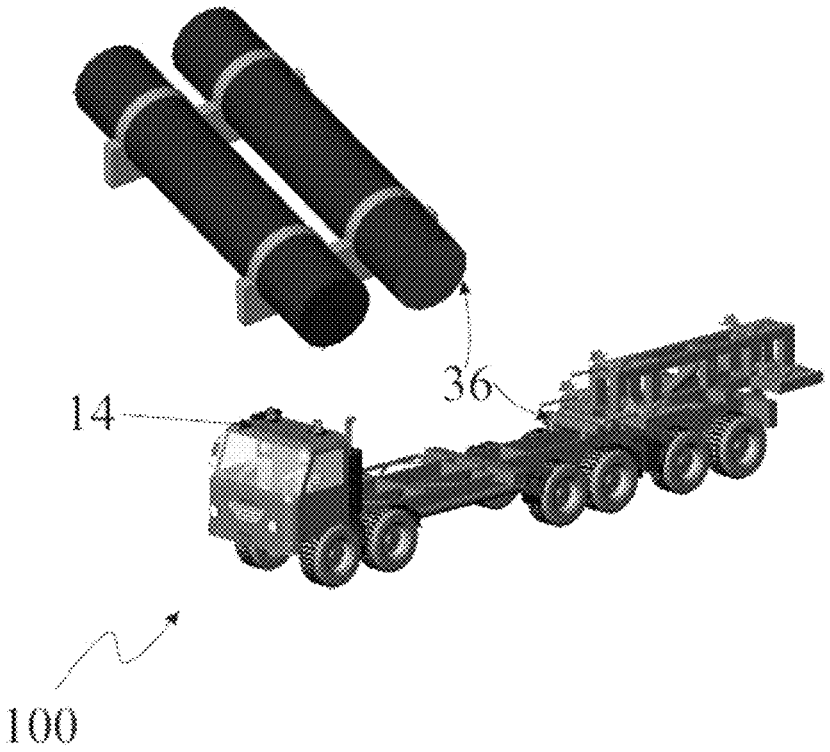
Figure 9:
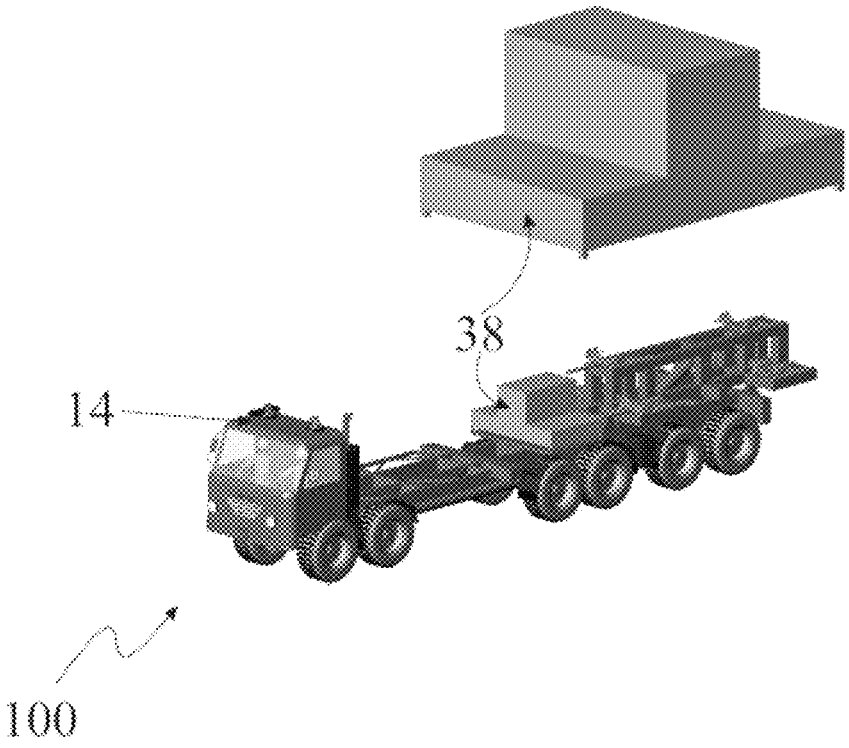
Figure 10:
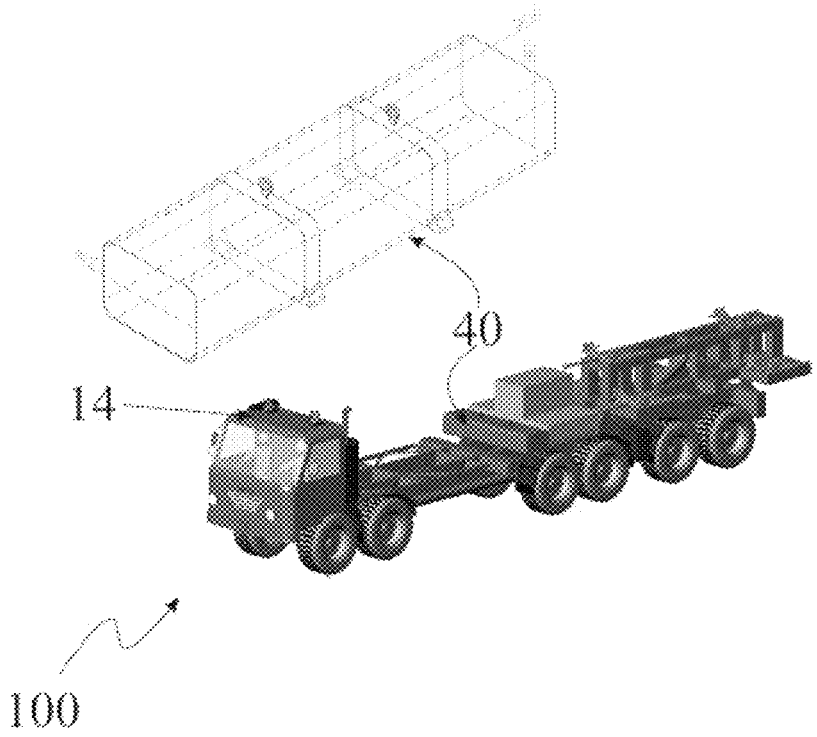
Figure 11:
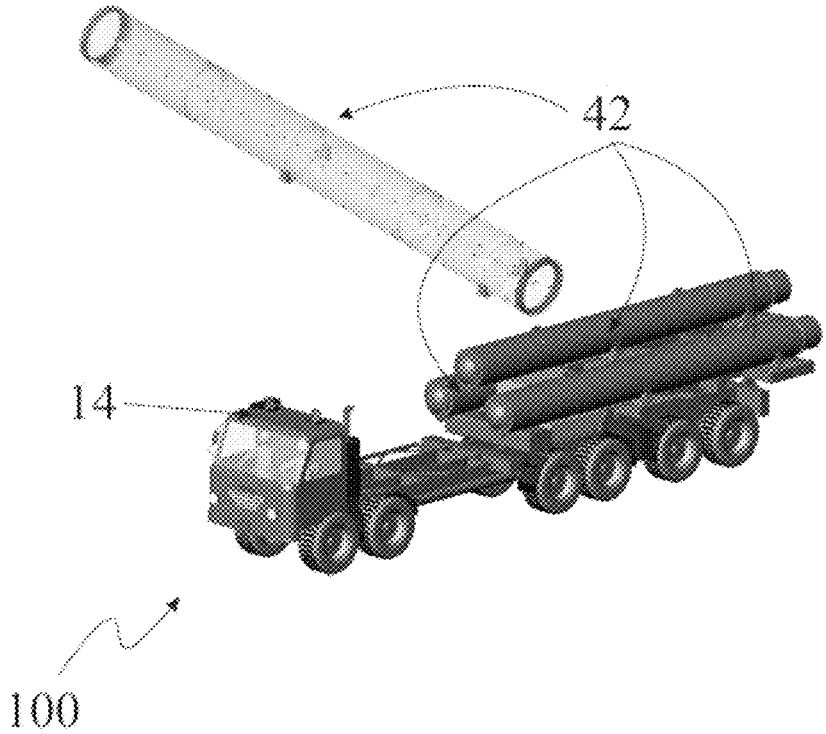
Figure 12:
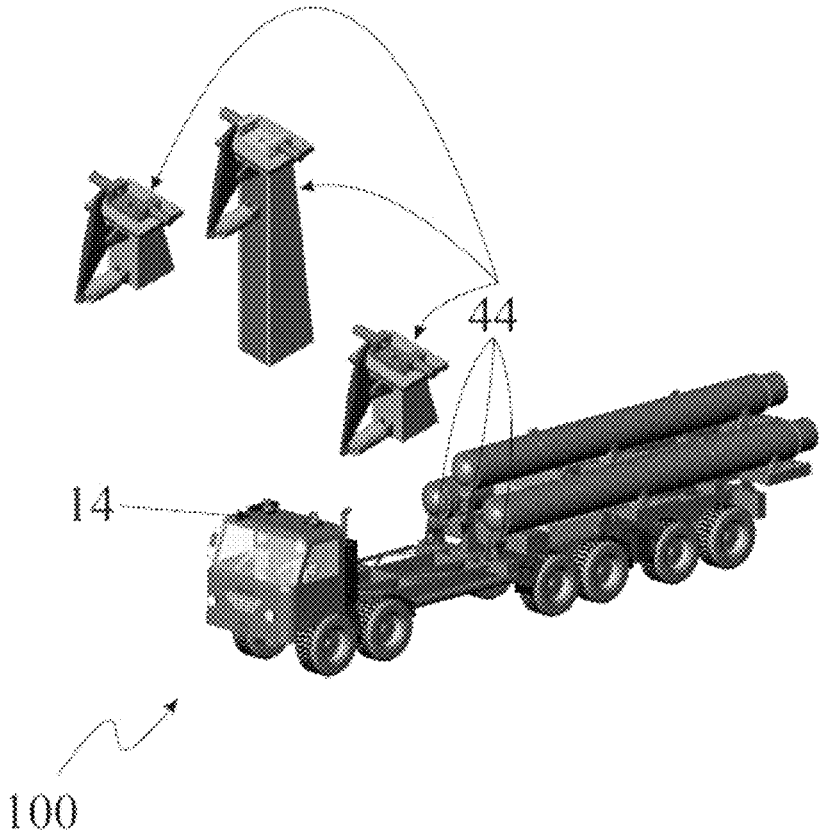
Figure 13:
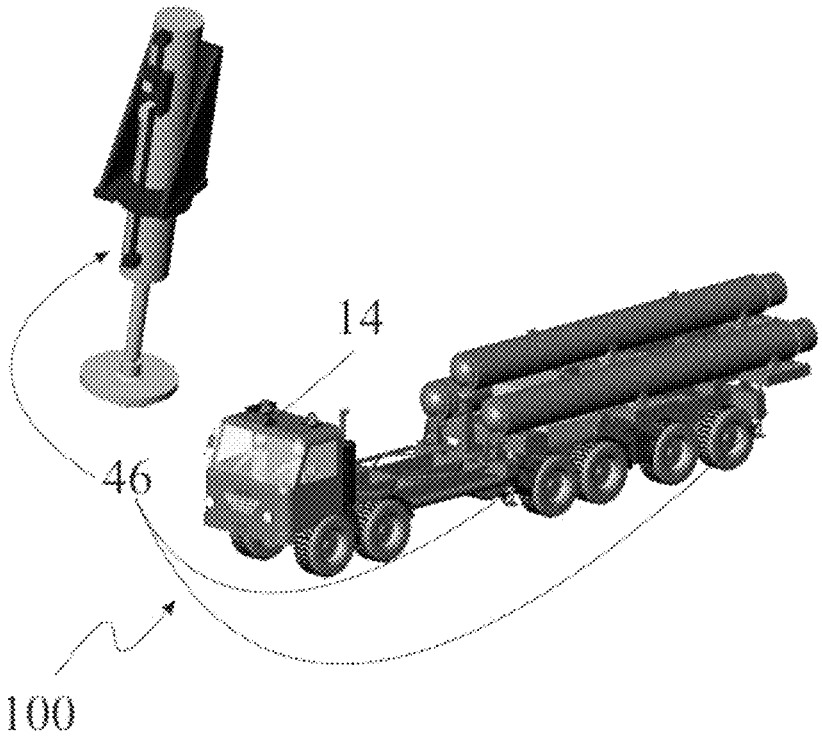
Figure 14:
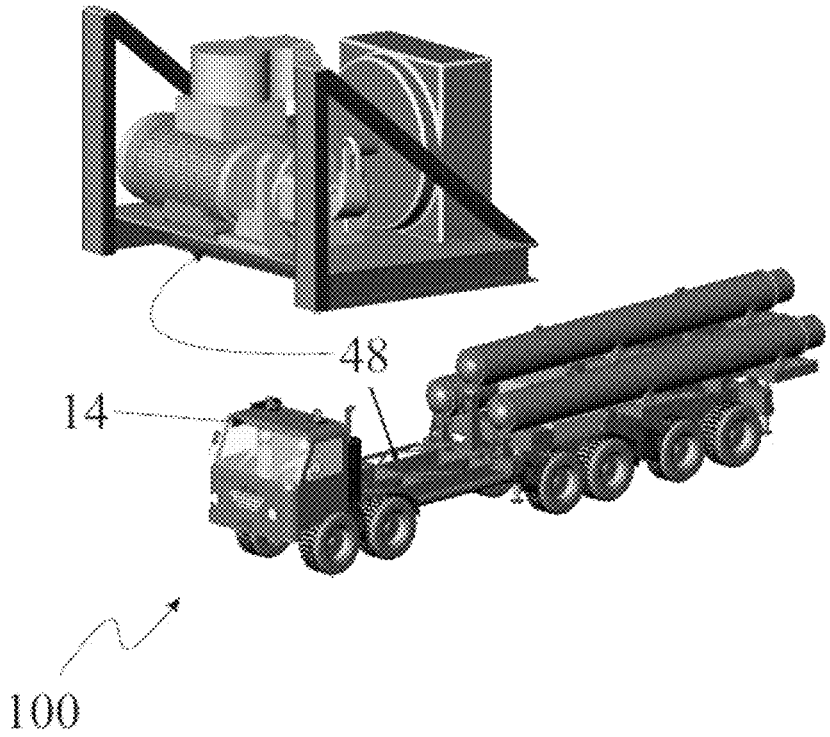
Figure 15:
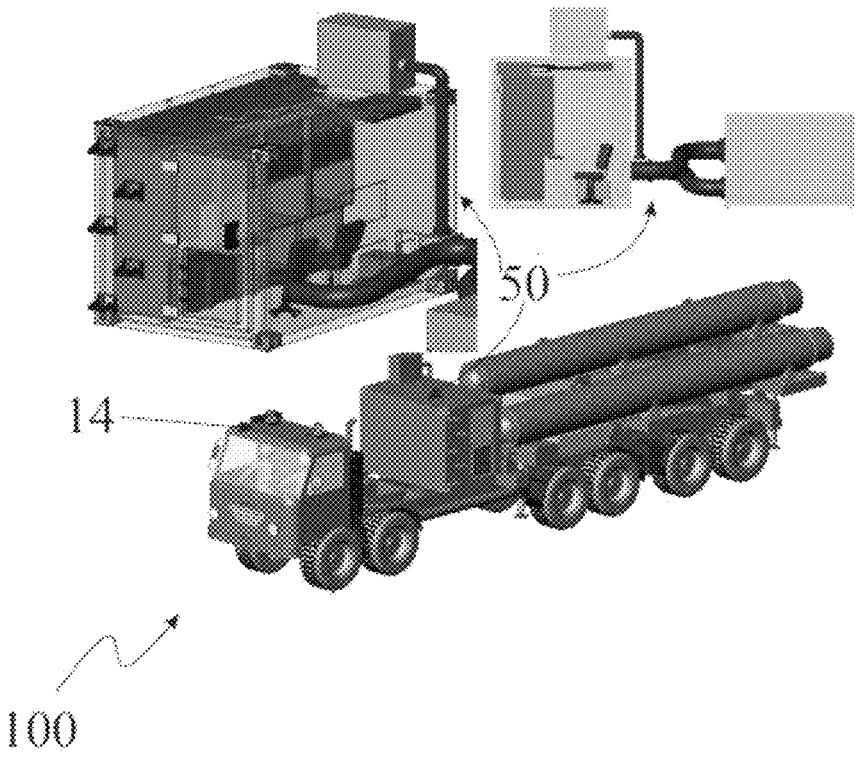
Figure 16:
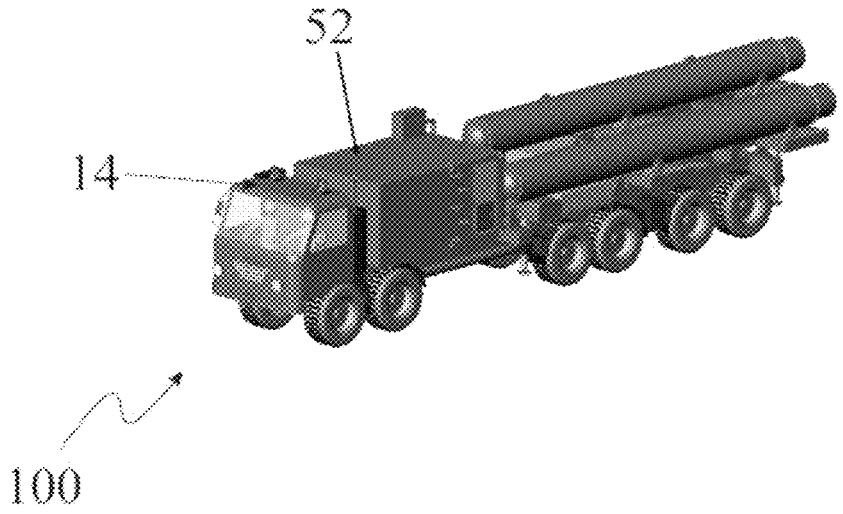
Figure 17:
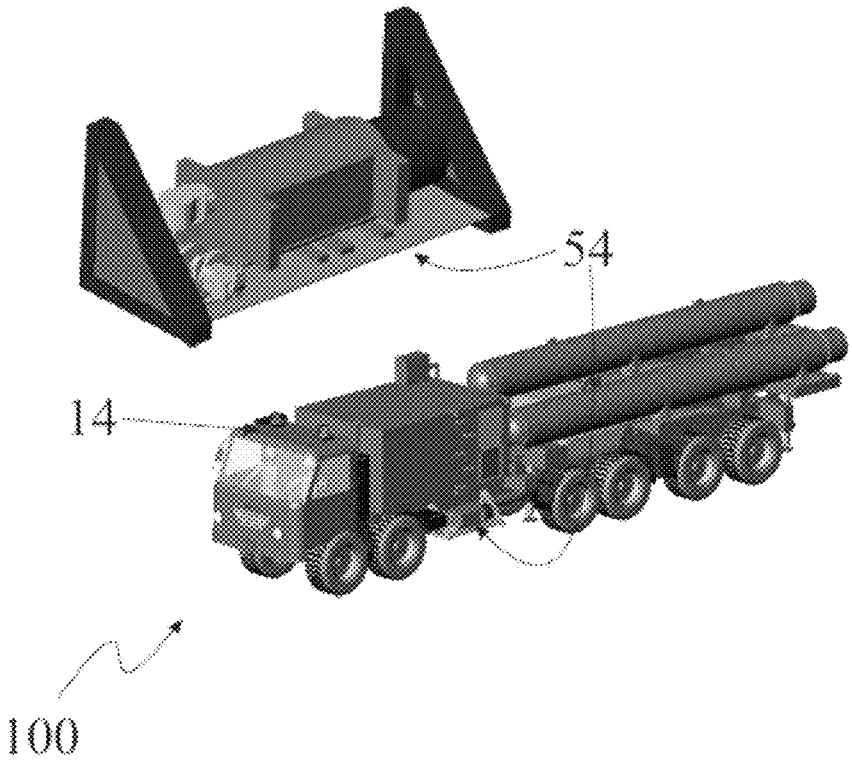
Figure 18:
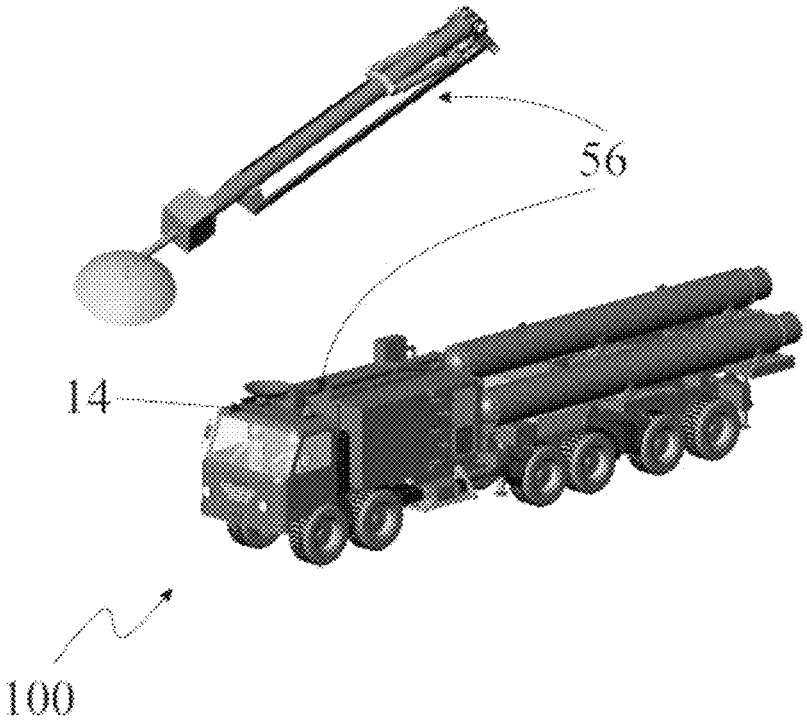
Figure 19:
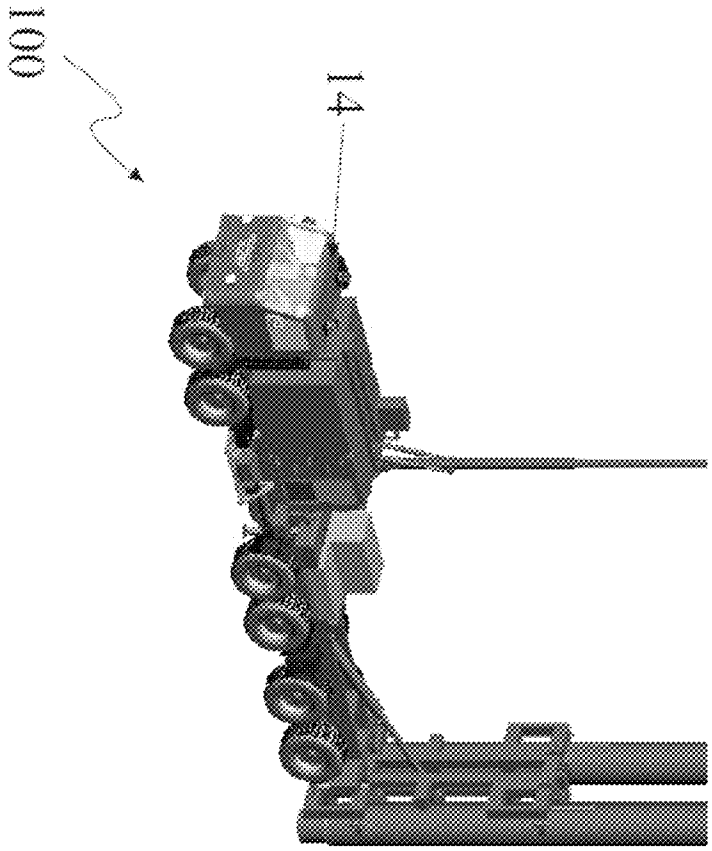
Figure 20:
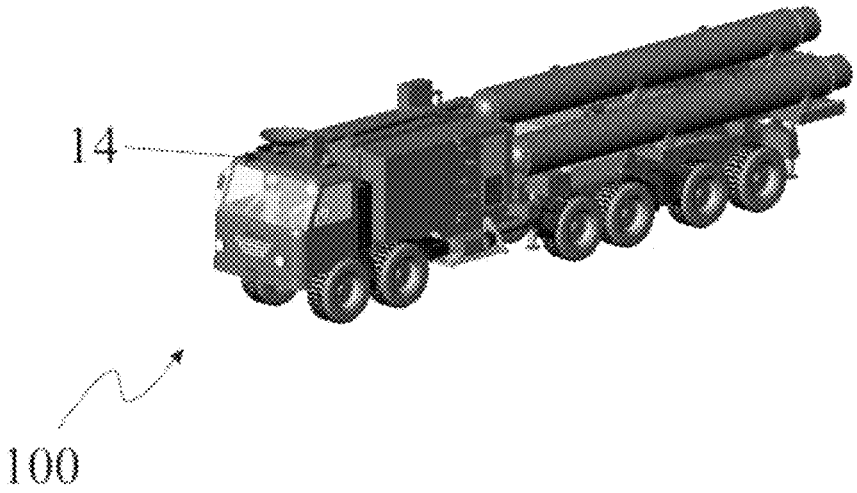

FIGS. 1 to 20 illustrate a step-by-step exploded view of the various embodiments of the mobile missile launching system (100) in accordance with this invention. A mobile system (100) in accordance with this invention for launching missiles comprises a vehicle (14), typically a truck having a wheeled chassis structure (12) [as shown in FIG. 1], a wheeled cabin (10) adapted to provide controls for maneuvering said vehicle (14) and a mounting frame/base structure (16) [as shown in FIG. 2] on said chassis structure (12) of said vehicle (14). The truck is suitably and adequately modified to carry a plurality of missiles (11) in canisters (43) and loaded within containers (42) [shown in FIG. 11] and is further adapted to engage said missiles (11) in operative position ready for accurate and quick deployment. The mounting frame/base structure (16) in accordance with this invention is typically a truss assembly and comprises two sections; a rear portion (19) which supports a plurality of missiles (11) and a front section (18) which supports the equipment control cabin (50) to provide firing and control signals to said canisterised missiles (11) within said container (42) and also supports the power supply unit (50). The system and controls at the equipment control cabin (50) are adapted to perform a health check of the operability of electronic circuits and components relating to glitch-free functioning of the mobile missile launcher (100). To support the plurality of containers (42) containing canisterised missiles (11), a launch beam (22) [as shown in FIG. 3] is mounted on the rear portion (19) of said mounting frame/base structure (16). A launch beam articulation cylinder (24) [as shown in FIG. 4] is mounted such that upon hydraulic actuation, the launch beam articulation cylinder (24) articulates the launch beam (22) from an inoperative horizontal position to an operative vertical position ready for launch. The launch beam (22) comprises a plurality of LM (linear motion) guides/sliders (26) [as shown in FIG. 5] mounted at strategic locations on said launch beam (22). Each of the LM guides (26) is a combination of a metal block (28) and a metal railing (30) such that said metal block (28) is slide-ably, co-axially fitted onto a metal railing (30) in a configuration such that the metal block (28) is adapted to slide along the length of the metal railing (30). A plurality of saddles (32 and 34) [as shown in FIGS. 6 and 7]; front saddles (32) and rear saddles (34) are adequately located on the LM guides (26) of the launch beam (22) in order to provide support for container (42) containing canisterised missiles (11) [as shown in FIG. 11]. The saddle is substantially a U-shaped configuration; the vertical arms of the saddle engage with the container (42). The container (42) is provided with elements which are welded onto it and protrude out of the container (42), like ears. These elements engage with the arms of the saddle (32, 34) while it rests on the saddle (32, 34). These welded elements are clamped onto the arms by clamping means for locking the container (42) onto the saddles (32, 34). The canister (43) is made of composite material. The missile (11) is assembled into the canister (43) at the factory and is hermetically sealed. The canisterised missile is inserted inside a container (42) for mounting on said launch beam (22) of said mobile missile system (100). The basic function of the container (42) is to hold the canister (43) during articulation from inoperative horizontal position to operative vertical position. A ground resting unit (27) [GRU] {as shown in FIGS. 1, 2, and 22} is fitted onto the operative bottom of the container (42) to provide a stable launching pad i.e. typically to transfer the load of the canisterised missile (11) uniformly onto the ground (51), irrespective of the texture of the ground surface. An accumulator (36) [as shown in FIG. 8] for high speed articulation is located in front of the launch beam (22) on the mounting frame/base structure (16). A thermal conditioning unit (38) [as shown in FIG. 9] sits ahead of the accumulator (36) on the mounting frame/base structure (16) to store hydraulic fluid required for said actuating cylinder (24). The thermal conditioning unit (38) is adapted to maintain temperature range for missile between −2° C. and +35° C. for providing an optimum launching environment. Further ahead, a hydraulic reservoir (40) [as shown in FIG. 10] is located on the mounting frame/base structure (16). The entire assembly comprising the launch beam (22), the accumulator (36), the thermal conditioning unit (28) and the hydraulic reservoir (40) sits atop the rear portion (19) of the mounting frame/base structure (16). Front supports (44) [as shown in FIG. 12] which include holding and locking mechanisms for holding the container (42) in its inoperative condition and locking the unwanted linear movement of the container (42) in the forward direction are provided at the operative front end of the container (42) on the mounting frame/base structure (16). Typically, two holes are located at the front of the container (42) and the locking and holding mechanism (44) of the container (42) is facilitated by engagement and disengagement of pins located at these holes. A rocker assembly (101) located in line with the axis of the container (42) and engaged onto the nose of the container (42) prevents forward linear motion of the container (42) whilst transportation. A plurality of outriggers/stabilizers (46) [as shown in FIG. 13] are provided at the base of the vehicle (14) in order to provide firm support to the vehicle (14) while at halt and during deployment of the articulating and missile launching mechanism. Partial load transfer takes place when the outriggers/stabilizers (46) are employed from the wheels of the vehicle (14) onto said outriggers/stabilizers (46). The front section (18) of the mounting frame/base structure (16) supports a system (48) [as shown in FIG. 14] of hydraulic pumps, motor, fan and the like in conjunction with an equipment control cabin (50) [as shown in FIG. 15] to form a power supply cabin (52) [as shown in FIG. 16]. The pump is typically an offline filtering pump to facilitate in-flow and out-flow of hydraulic fluid for hydraulic actuation through launch beam articulation cylinder (24) [as shown in FIG. 4]. The driver cabin (10) is adapted to supply power to drive hydraulic system [hydraulic pump and launch beam articulation cylinder (24)]. In steady state configuration, i.e. when the vehicle (14) has come to a halt and the engine power is no longer used for driving the vehicle (14), the driving gear of the vehicle (14) is disengaged and the engine is typically kept running in neutral condition, a part of the vehicle's engine power is adapted to be used for launching missiles (11) from said vehicle (14). A system (54) [as shown in FIG. 17] comprising an alternator and a motor is provided at the base of the power supply cabin (52), as an alternate source of power supply. A communication mast (56) [as shown in FIG. 18] is provided for communication with a remotely located control unit, typically with a communication post for exact positioning of vehicle (14) and for identification and location of proposed launch site such that accurate deployment of missiles (11) take place. Typically, a diesel generator set of 5 kVA rating is operated to fulfill the power requirement of a Master Inertial Navigation System and for other lighting purposes. For operational purposes of the missile articulating system, the diesel generator set is operated at 40 kVA rating. The power generated is routed through an uninterrupted power supply system to all electronic equipment of the system (100) i.e. the fire control system, the communication system, the launcher control system and the like.

FIGS. 21*a*, 21*b*, and 21*c* illustrate the missile articulating system of the mobile missile system in accordance with this invention. A vehicle (14) used for securely transporting and launching a missile from a canister (43) located within a container (42) is provided with a launch beam (22) having linear motion guides or sliders (26). Missiles (11) are ensconced within canisters (43) which are placed in containers (42). The canister projects out of the container (42) at its operative bottom end. The containers (42) are mounted on the launch beam (22) by means of saddles (32, 34). Thus the missile (11) is substantially parallel to the launch beam (22). There are two types of saddles; a front saddle (32) and a rear saddle (34). These saddles (32, 34) are independent of each other i.e. they independently engage with the container (42), but are mounted co-axially on linear motion guides (26). The independency of the saddles (32, 34) takes care of machined defects of the container (42); the container (42) and saddle (32, 34) configuration is adjusted to achieve a substantially horizontal resting configuration or a vertical operative configuration. The container (42) is bolted to the canister (43) at its operative top end. A shear pin located substantially at the top end holds the canister within the container (42) in a fixed state. The launch beam (22) is adapted to articulate from its inoperative horizontal position to its operative vertical position by means of a hydraulic actuator (24).

In its operative states, the launch can be detailed as follows:

Firstly, the launch beam (22) hydraulically actuates from its inoperative horizontal resting state to its operative vertical state i.e. to achieve the position as shown in FIG. 21*a* of the accompanying drawings. Typically, this action takes about 30 seconds. After this is complete, the hydraulic piston (29) is lowered slowly so as to allow the container (42), canister (43) and missile (11) come down by gravity. This is shown in FIG. 21*b* of the accompanying drawings. A tube (35) comprising a rod (37) moves downwardly along the linear motion guides (26) to allow the GRU (27) to rest on the ground (51). Further, the piston (29) within the actuator cylinder (31) starts retracting downwards till it reaches the operative bottom end within the actuator cylinder (31) in which it is housed so that no load is acting on the rod (37) and the socket (39). This is shown in FIG. 21*c* of the accompanying drawings. The lowering of the missile containers (42) takes about 20 to 30 seconds. At the time of launch, large downward forces act on canister (43), the container (42) and the tube (35) forcing them in a further downward direction guided along the linear motion guides (26) until the GRU (27) starts penetrating the ground (51) in scenarios where the ground (51) allows such penetration. This is shown in FIG. 21*c* of the accompanying drawings. The penetration has a maximum range, typically of 600 mm. Once the launch is complete, the piston (29) is retracted upwards and the GRU (27) is pulled out of the ground (51). The possible piston (29) movement decides the allowable penetration of the GRU (27)/canister in the ground (51).

In a typical cold launch scenario, a gas generator operates. This removes the missile (11) from the canister (43) until the shear pin [used for locking missile (11) to canister] breaks. Typically, the velocity achieved during this operation is about 20 m/s to 50 m/s.

Further, a low thrust booster operates. This enables the missile (11) to eject out of the canister (43) and container (42), typically up to a height of 200 m to 250 m above the launching site. At this height, on-board computers operate in order to pitch the missile (11) in its operative target direction.

Still further, a high thrust booster ignites in order to aid the missile (11) to traverse the pre-fed distance to reach the target.

While considerable emphasis has been placed herein on the specific elements of the preferred embodiment, it will be appreciated that many alterations can be made and that many modifications can be made in the preferred embodiment without departing from the principles of the invention. These and other changes in the preferred embodiment as well as other embodiments of the invention will be apparent to those skilled in the art from the disclosure herein, whereby it is to be distinctly understood that the foregoing descriptive matter is to be interpreted merely as illustrative of the invention and not as a limitation.

We claim:

1. A mobile missile launch system, said system comprising:

a vehicle having a chassis structure adapted to carry the launch system;

a mounting frame comprising predetermined truss framework mounted onto the chassis structure;

a plurality of sliding mechanisms mounted at a rear end of the mounting frame comprising: a beam comprising a plurality of sliders on one surface of the beam and hinged to the mounting frame on another surface of the beam, a plurality of saddles mounted onto the beam and adapted to slide on the sliders, a tube having openings and being fixed to at least one of the plurality of saddles at one end of the tube and an end cap at an other end of the tube, and an actuator connected to the tube through a piston and a rod and hinged at one end on the beam, wherein actuation of said piston contacts the rod with end cap of the tube to slide the saddles on the sliders;

a plurality of canisters mounted onto said beam and a plurality of missiles ensconced within the canisters;

a plurality of containers enclosing said canisters and connected to the saddles for linear movement;

a plurality of resting units abutting to rear ends of the canisters and adapted to move linearly to transfer reaction forces from said missiles to the ground;

communication means placed within the launch system to communicate with a remotely located unit; and at least one locking mechanism and at least one holding device mounted at a front end of each container to arrest linear motion of the container during mobility in a horizontal position.

2. The system as claimed in claim 1, wherein the truss frame work of the mounting frame is configured as front frame work and rear truss frame work for varying loads of mountings on it; wherein the front is configured for mounting actuators of hydraulic actuator for articulation by piston movement, fire control section and power supply cabin, and the rear truss frame work is configured for mounting the beam and actuators for articulation.

3. The system as claimed in claim 1, wherein said system is fitted with a thermal conditioning unit to regulate temperature inside the canister and a plurality of accumulators connecting to actuators and adapted to store for articulation of the beam.

4. The system as claimed in claim 1, wherein the holding device comprises:

a platform of predetermined shape having at least one bracket consisting of one or more apertures and at least one hole at centre;

a detachable stub element integrated with the missile below tip surface and mounted inside the bracket of the platform, said stub comprising one or more stub holes to accommodate pins provided at a preformed shaped element and has at least one protruding element at centre, wherein said protruding element is mounted inside the hole of platform;

a plurality of hydraulic cylinders having a shaft and mounted at predefined positions onto the platform on either side of the bracket; and a plurality of housing elements fitted to the preformed shaped element;

wherein the shaft of each hydraulic cylinder is fitted with preformed shape of bearing.

5. The system as claimed in the claim 4, wherein the shaft of cylinder, the bearings, the housing element and the preformed shaped element form a ball and socket mechanism.

6. The system as claimed in the claim 4, wherein pins pass through the apertures in the bracket to get inserted in the holes of the stub element.

7. The system as claimed in claim 1, wherein the locking mechanism to arrest linear motion of the missile comprises:

a rocker assembly of predetermined shape pivoted at a bracket of the system, said rocker assembly comprising an actuating segment at a lower side and a loading segment at upper side and a rocker segment disposed in between the actuating segment and the loading segment;

an actuator assembly connected to a lower end of platform of the system for applying load to the rocker assembly; and loading elements engaged at an operative top end of the rocker assembly to arrest linear motion of the missile.

8. The system as claimed in claim 7, wherein the rocker assembly is tapered away from the rocker segment and leads to the actuating segment at said lower side and the loading segment at said upper side.

9. The system as claimed in claim 7, wherein said rocker assembly is pivoted with a medially placed pivoting arrangement; wherein the pivoting arrangement and the bracket have matching holes to superimpose onto each other; and the pivoting arrangement is secured by inserting a pin and circlip through the matching holes.

10. The system as claimed in the claim 7, wherein the actuator assembly comprises a plurality of pre-tensioned springs placed between arms of a clevis and a rear wall, and a hydraulic actuator having a piston with a boss at its operative end and the clevis with a plurality of the arms aligned with the piston.

11. The system as claimed in the claim 10, wherein the springs are Belleville springs and said piston is placed symmetrically in between the springs.

12. The system as claimed in the claim 7, wherein the loading elements comprises a loading socket and a loading pin aligned in a horizontal linear axis configuration with a nose cap projection for applying a point load onto the missile.

13. A method of launching a missile using the mobile missile launch system of claim 1, said method comprising:

actuating the beam, by a further actuator, to move from a horizontal position to a vertical position;

actuating the actuator of the sliding mechanism by releasing pressure, wherein said releasing of the pressure allows at least one of said resting units to touch ground; and launching of the missile using control switches, wherein thrust forces generated by the launch of the missile is transferred to the ground through said at least one resting unit.

14. The method as claimed in claim 13, wherein said method comprises retracting the piston upwards to release the at least one resting unit from the ground after launching.

* * * * *